US008276650B2

(12) United States Patent
Martin et al.

(10) Patent No.: US 8,276,650 B2
(45) Date of Patent: Oct. 2, 2012

(54) MACHINE HAVING SELF-CLEANING COOLING SYSTEM AND METHOD

(75) Inventors: Kevin L. Martin, Washburn, IL (US); James J. Callas, Peoria, IL (US); Michael J. Campagna, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 1218 days.

(21) Appl. No.: 11/804,637

(22) Filed: May 18, 2007

(65) Prior Publication Data

US 2008/0283220 A1 Nov. 20, 2008

(51) Int. Cl.

| | |
|---|---|
| ***B01D 46/18*** | (2006.01) |
| ***B01D 46/20*** | (2006.01) |
| ***B01D 46/22*** | (2006.01) |
| ***F24F 1/00*** | (2006.01) |
| ***F24F 13/28*** | (2006.01) |
| ***B60H 3/06*** | (2006.01) |
| ***F01P 11/12*** | (2006.01) |

(52) U.S. Cl. ..... 165/41; 165/51; 165/95; 165/119; 165/122; 165/140; 55/282.4; 55/290; 55/302; 55/304; 55/351; 55/293; 55/385.3; 123/41.49; 180/68.6; 62/303

(58) Field of Classification Search ..... 165/41, 165/44, 119, 95, 122, 51, 140; 55/282.4, 55/290, 304, 351, 293, 302, 385.3; 180/68.6; 62/303

See application file for complete search history.

(56) References Cited

U.S. PATENT DOCUMENTS

| | | | | |
|---|---|---|---|---|
| 2,752,003 | A * | 6/1956 | Hersey, Jr. et al. | 55/290 |
| 3,309,847 | A | 3/1967 | Donaldson | |
| 3,344,854 | A | 10/1967 | Boyajian | |
| 3,402,881 | A | 9/1968 | Moore et al. | |
| 3,592,563 | A | 7/1971 | Glass | |
| 4,057,105 | A | 11/1977 | Bailey | |
| 4,066,119 | A | 1/1978 | Stedman | |
| 4,125,147 | A | 11/1978 | Bailey | |
| 4,294,596 | A | 10/1981 | Taverez | |
| 4,364,751 | A | 12/1982 | Copley | |
| 4,536,200 | A | 8/1985 | Reist | |
| 5,401,285 | A | 3/1995 | Gillingham et al. | |
| 5,426,936 | A | 6/1995 | Levendis et al. | |
| 5,575,826 | A | 11/1996 | Gillingham et al. | |
| 5,616,171 | A | 4/1997 | Barris et al. | |
| 5,901,786 | A * | 5/1999 | Patel et al. | 165/41 |

(Continued)

FOREIGN PATENT DOCUMENTS

| | | | |
|---|---|---|---|
| DE | 3234436 | A * | 3/1984 |
| DE | 4207274 | A1 * | 9/1993 |
| JP | 58174115 | A * | 10/1983 |
| JP | 01224026 | A * | 9/1989 |

(Continued)

OTHER PUBLICATIONS

Caterpillar Inc; Retarding and Filter Cleaning Method and System; U.S. Appl. No. 11/289,321, filed Nov. 30, 2005.

*Primary Examiner* — John Ford
(74) *Attorney, Agent, or Firm* — Liell & McNeil

(57) ABSTRACT

A machine includes a heat exchanger for an engine having a heat exchanger core and a filtration system. The filtration system includes a flexible filter sheet coupled with at least one take-up roller and a filter cleaner adapted to clean the filter via compressed air. A method of operating a machine cooling system includes rotating a rotatable drive element coupled with a filter, and cleaning the filter by directing compressed air therethrough.

7 Claims, 4 Drawing Sheets

U.S. PATENT DOCUMENTS

| | | | | |
|---|---|---|---|---|
| 5,912,423 | A * | 6/1999 | Doughty et al. | 95/107 |
| 6,217,637 | B1 * | 4/2001 | Toney et al. | 95/277 |
| 6,908,494 | B2 | 6/2005 | Gillingham et al. | |
| 7,418,997 | B2 * | 9/2008 | Martin et al. | 165/95 |
| 7,608,121 | B2 * | 10/2009 | Boyer et al. | 55/282.2 |
| 2005/0120881 | A1 | 6/2005 | Sporre et al. | |

FOREIGN PATENT DOCUMENTS

| | | | |
|---|---|---|---|
| JP | 09141034 | A * | 6/1997 |
| JP | 11156129 | A * | 6/1999 |
| JP | 2001208378 | A * | 8/2001 |
| JP | 2002219321 | A * | 8/2002 |
| SU | 622701 | A * | 8/1978 |

* cited by examiner

MACHINE HAVING SELF-CLEANING COOLING SYSTEM AND METHOD

TECHNICAL FIELD

The present disclosure relates generally to machine cooling systems, and relates more particularly to a machine cooling system and method wherein a scrolling filter for cooling air is cleaned via compressed air.

BACKGROUND

Cooling systems such as radiators and the like are used in a wide variety of machine systems, notably in connection with internal combustion engines. Radiators employing a coolant fluid to extract heat from an engine and transfer the heat to cooling air are well known and widely used. While some means to reject heat is necessary in virtually all engines, such cooling systems occupy precious space and add weight, cost and complexity to engine systems. Cooling system effectiveness typically relates to heat exchange surface area, and thus size and weight of a given system. Engineers have heretofore found it challenging to develop suitable heat exchangers of conventional materials and construction in certain environments where factors such as size and weight are of particular importance.

A factor compounding attempts to utilize conventional heat exchangers in engine cooling systems is the recent implementation, and expected future implementation, of relatively more stringent emissions regulations. In some instances, engine manufacturers have turned to aftertreatment technology to reduce certain engine emissions, in many cases resulting in relatively bulky aftertreatment systems consuming volume within an engine compartment previously available for mounting heat exchanger and other cooling system components. Certain types of aftertreatment technology also raise the requirements for engine heat rejection. In other words, the available spatial envelope for cooling systems has shrunk, yet in many instances heat exchangers are now expected to operate more effectively.

Relatively smaller, highly efficient heat exchangers for engine cooling systems are now proposed. One drawback of such designs is that the heat exchange surfaces tend to be relatively tightly packed within the heat exchanger core. While certain of these designs work quite effectively, they have relatively smaller spaces for cooling air flow than conventional cores which tend to plug with airborne debris after a relatively brief service life. Debris within the core reduces heat exchanger effectiveness. Relatively fine dust particles stirred up during operation of off-highway construction equipment can be particularly problematic where high efficiency heat exchangers are used in such machines. One strategy for removing debris from heat exchanger cores is to simply halt machine operation, and manually remove debris clogging the heat exchanger core. This approach has been used for decades, but is obviously quite labor intensive and requires frequent machine down time.

Many cooling system designers have proposed inhibiting entry of debris into a heat exchanger core with filters. One example of this strategy is known from U.S. Pat. No. 3,344,854 to Boyagian. In Boyagian, a screen of a continuous loop of movable filter material is passed about a heat exchanger core. Incoming debris caught by the screen in Boyagian is circulated to another side of the cooling system by moving the screen so that air passed through the radiator via an engine fan can dislodge materials trapped by the screen. Boyagian's system would appear to be suitable for filtering relatively larger airborne debris such as leaves, straw or chaff, which can be relatively readily filtered via conventional screen material and blown from the screen relatively easily. A system with a highly dense radiator core, however, imparting substantial pressure drops to cooling air flowing therethrough, would likely be poorly served by a system such as Boyagian's as sufficient air velocity for clearing fine particulates would be difficult or impossible to achieve with a conventional engine fan.

The present disclosure is directed to one or more of the problems or shortcomings set forth above.

SUMMARY OF THE DISCLOSURE

In one aspect, the present disclosure provides a cooling system for a machine. The cooling system includes a heat exchanger core, and a housing for the heat exchanger core having a cooling air inlet. The cooling system further includes a filtration system having a flexible filter extending across the cooling air inlet and at least one rotatable drive element coupled with the filter. The cooling system further includes a filter cleaner configured to direct compressed air through the filter.

In another aspect, the present disclosure provides a machine having a frame and an engine mounted to the frame. The machine further includes a heat exchanger for the engine including a core and a filtration system. The filtration system includes a flexible filter configured to filter cooling air for the core, at least one rotatable drive element coupled with the filter and a filter cleaner configured to direct compressed air through the filter.

In another aspect, the present disclosure provides a method of operating a machine cooling system including a step of positioning a first portion of a flexible filter across a cooling air inlet for a heat exchanger of the machine cooling system. The method further includes the steps of rotating at least one rotatable drive element coupled with the filter to position a different portion thereof across the cooling air inlet, and cleaning the filter at least in part by directing compressed air through the first portion via a filter cleaner of the machine cooling system.

In still another aspect, the present disclosure provides a filter for a machine cooling system. The filter includes a first roller having a first end and a second end and a length extending between the first and second ends. The first roller further includes mounting elements adapted to position the first roller in at least one of a predefined orientation and a predefined location relative to a supporting element of the machine cooling system. The filter further includes a second roller also having a first end and a second end and a length extending between the first and second ends, the second roller also further including mounting elements adapted to position the second roller in at least one of a predefined orientation and a predefined location relative to a supporting element of the machine cooling system. The filter still further includes a flexible sheet of filter media having a first end attached to the first roller and a second end attached to the second roller. The sheet has a width dimension extending in a direction parallel the length of the rollers and also having a length dimension which is at least about twice its width dimension and oriented perpendicular thereto. At least one of the mounting elements includes a drive element configured to couple the corresponding roller with a rotating drive unit of the machine cooling system.

DETAILED DESCRIPTION

Figure 1:
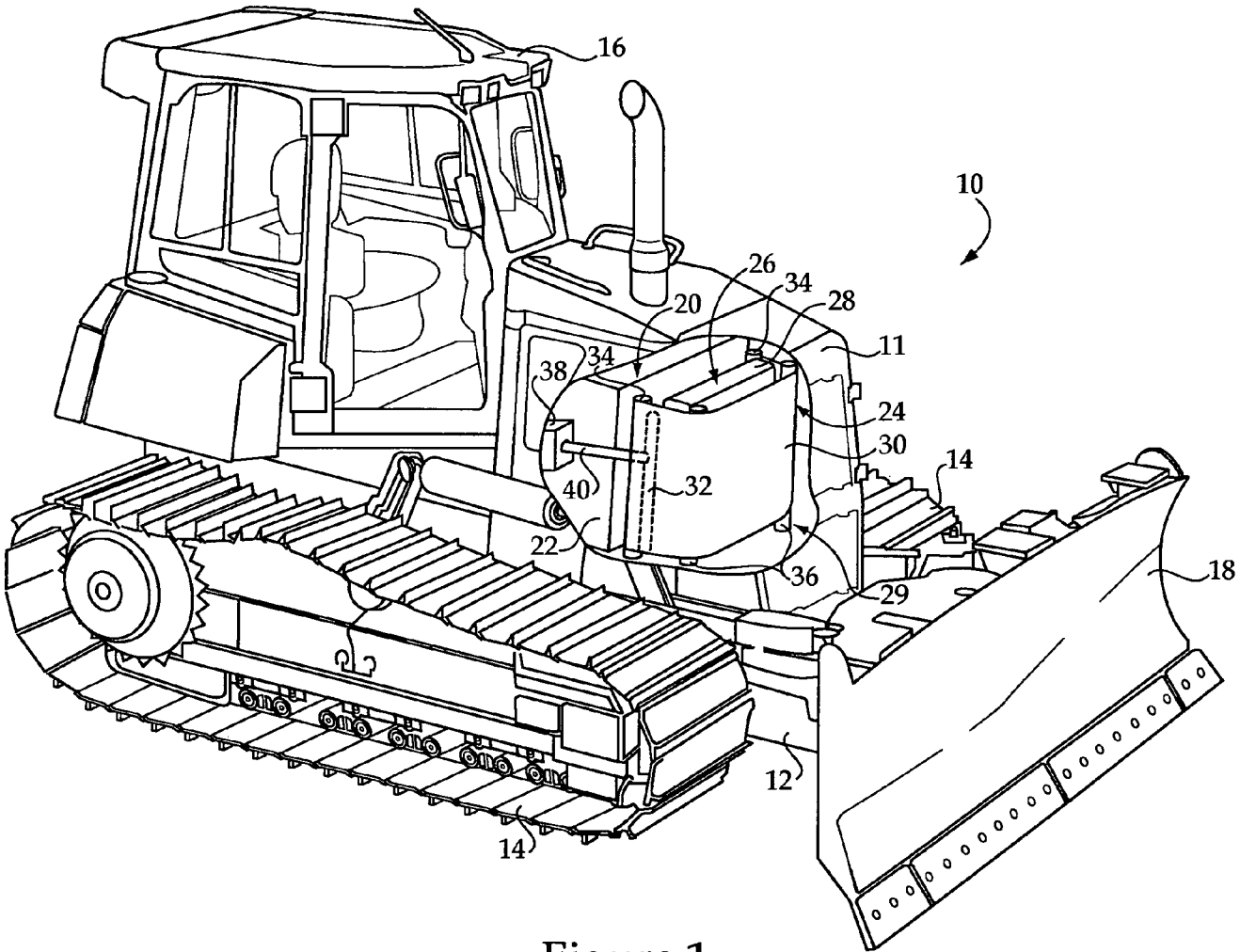
FIG. 1 is a diagrammatic view of a machine according to one embodiment.

Referring to FIG. 1, there is shown a machine 10 according to one embodiment. Machine 10 may include a frame 12 having ground engaging elements 14, such as tracks. An operator cab 16 may be mounted to frame 12, as well as an implement 18. Machine 10 is shown in the context of a track-type tractor, however, it should be appreciated that the present disclosure is not thereby limited and a wide variety of machines, including both mobile and stationary machines, are contemplated herein. For example, rather than a machine such as a track-type tractor, machine 10 might include a truck or a loader, or any of various other off-highway or on-highway machines. Machine 10 may further include an engine 22 mounted to frame 12 and positioned within an engine compartment 20. A cooling system 24 for engine 22 is further provided, and includes a unique strategy for filtering cooling air, as further described herein. While it is contemplated that cooling system 24 may be implemented in the context of engine cooling, the present disclosure is also not limited in this regard and other machine cooling systems might be constructed and operated according to the teachings set forth herein.

Cooling system 24 may include a heat exchanger 26 configured to control a temperature of engine 22 in a conventional manner, for example via circulation of engine coolant to engine 22, and subsequent cooling of the heated coolant fluid with cooling air, as further described herein. Heat exchanger 26 may include a heat exchanger housing 28, the details of which are further described herein. A filtration system 29 comprising a filter 30, such as a flexible sheet of filter media, is configured to filter cooling air for heat exchanger 26. Filter 30 may extend about a plurality of rollers, including at least one rotatable drive roller 34, for example two drive rollers, as well as one or more guide rollers 36. Rollers 34 may comprise take-up rollers about which filter 30 is wrapped as it scrolls across a front of heat exchanger 26. In the illustrated embodiment, filter 30 may be interposed a grill 11 and heat exchanger 26 such that cooling air passing through grill 11 is filtered prior to passing through heat exchanger 26. While rollers 34 and 36 are contemplated to provide one practical implementation strategy for moving filter 30 when desired, the present disclosure is not thereby limited. In other embodiments, filter 30 might be configured with grommets or the like which engage with a toothed rotating member rather than wrapping about take-up rollers.

As alluded to above, cooling system 24 may further include a unique means for cleaning filter 30. In one embodiment, filtration system 29 may include a filter cleaner 32 having at least one compressed air outlet (not shown in FIG. 1) which is configured to direct compressed air through filter 30 to remove debris. Filter cleaner 32 may be connected with a source of compressed air 38 via a compressed air supply line 40. Embodiments are contemplated wherein compressed air source 38 comprises a turbocharger for engine 22, permitting compressed air to be siphoned off for use by filter cleaner 32 as needed. In other embodiments, compressed air source 38 might include a stand-alone air compressor, or some other on-board source of compressed air.

Figure 2:
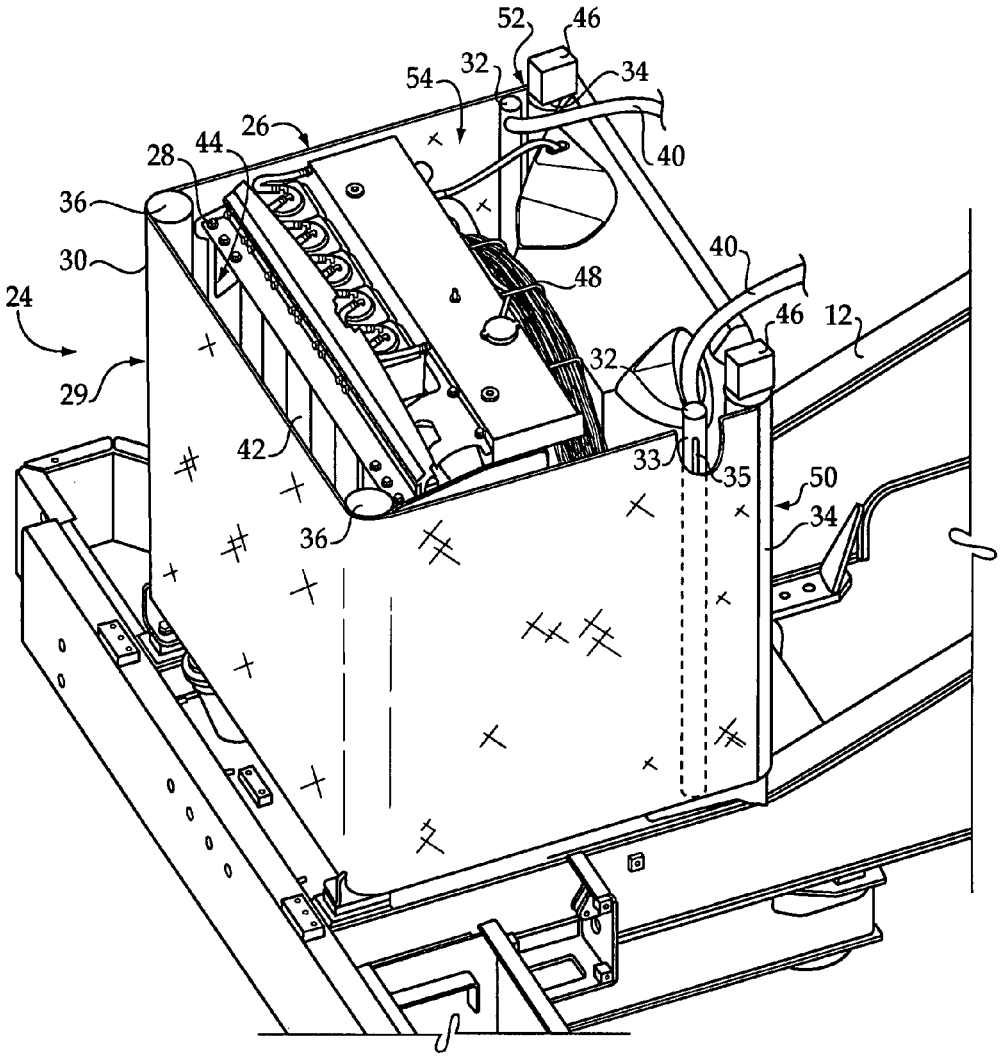
FIG. 2 is a diagrammatic view of a cooling system according to one embodiment.

Referring now also to FIG. 2, there is shown a cooling system 24, similar to that shown in FIG. 1, as it might appear mounted to frame 12 apart from the other components of machine 10. It may be noted from the FIG. 2 illustration that filter 30 includes a first end 50 attached to one take-up roller 34, and a second end 52 attached to another take-up roller 34. Motors 46 such as electric motors may be coupled with take-up rollers 34 to rotate them in alternating directions, rolling filter 30 about the corresponding roller. The embodiment of FIG. 2 is also shown having two filter cleaners 32 each positioned adjacent one of take-up rollers 34. In one embodiment, each filter cleaner 32 may comprise an air knife having a housing 35 extending across filter 30. Each filter cleaner 32 may have at least one compressed air outlet 35, for example a plurality of outlets or a slit, which directs compressed air supplied via supply lines 40 through filter 30 prior to filter 30 being wrapped about the corresponding roller 34. Air will be directed via filter cleaners 32 in a direction different from the incident flow of cooling air. It will typically be desirable to remove debris prior to rolling sheet 30 onto one of rollers 34, and accordingly only one of filter cleaners 32 might be used at any one time, depending upon the direction which filter 30 is being scrolled.

A cooling air inlet 44 may be located at one side of housing 28 as shown, such that cooling air may be provided to a heat exchanger core 42 of heat exchanger 26. Inlet 44 may be located at a front side of housing 28, which also includes a left side, a right side, and a back side, as shown in FIG. 2. Housing 28 may also include at least one cooling air outlet 54 positioned downstream of cooling air inlet 44, and also downstream of a fan 48 which is configured to draw cooling air through filter 30, inlet 44, through core 42, and subsequently push cooling air out through outlet 54. Where two outlets are used, one of the outlets may be disposed on each of the left and right sides of housing 28. In one exemplary embodiment, fan 48 may push cooling air out of housing 28, and also through filter 30. It may also be noted from FIG. 2 that filter 30 extends from the first take-up roller 34 to the second take-up roller 34 about the front, left, and right sides of housing 28 such that a total of one layer of filter 30 extends across inlet 44 and outlet(s) 54. Although a variety of core designs are possible, heat exchanger core 42 may comprise a high-efficiency primary surface heat exchanger of the type commercially available from Mezzo Technologies of Baton Rouge, La. Such heat exchanger cores have a relatively large number of microchannels through which cooling air can pass to exchange heat across a primary surface with another fluid such as engine coolant.

Figure 3:
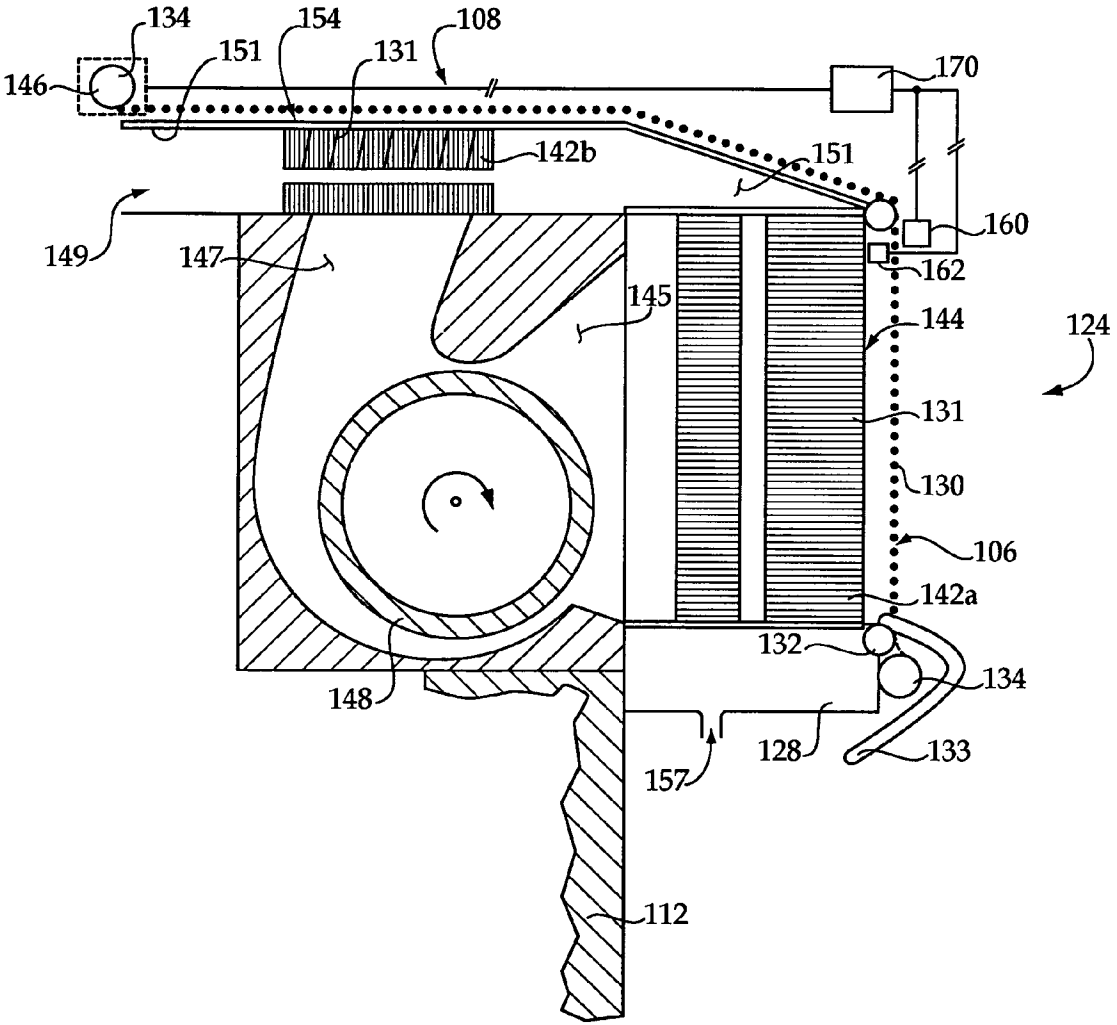
FIG. 3 is a partially sectioned side diagrammatic view of a cooling system according to one embodiment.

Turning now to FIG. 3, there is shown a cooling system 124 according to another embodiment. Cooling system 124 is suitable for use in applications similar to those of cooling system 24 such as in machine 10, and has certain similarities therewith. Cooling system 124 may include a housing 128 and a flexible filter 130 configured to move across a cooling air inlet 144, and wrap about take-up rollers 134, when scrolled in alternating directions across cooling air inlet 144. Cooling system 124 might also be mounted to a frame 112. In contrast to cooling system 24 described above, cooling system 124 may include a tangential fan 148. A wide variety of fans may be used in connection with cooling systems contemplated herein, however, in instances where relatively dense heat exchanger cores are used which provide correspondingly small flow areas for cooling air, tangential fans may be advantageous, due to their relatively greater effectiveness at moving air across larger pressure drops. Cooling system 124 also differs from cooling system 24 in that rather than a single core, a first core section 142*a* and a separate second core section 142*b* are provided. Fan 148 may be configured to draw air from air inlet 144, at a front side 106 of system 124, through first core section 142*a* and into an inlet passage 145. After passing through first core section 142*a*, cooling air may be pushed by fan 148 through a second core section 142*b* and thenceforth out a cooling air outlet 154 at a top side 108 of system 124.

Cooling system 124 may also be a primary surface liquid to air heat exchanger, similar to the type described above and suitable for use in cooling an engine system. To this end, a fluid inlet 149 is provided which connects with a fluid passage 151 configured to permit flow of fluids such as engine coolant through each of core sections 142*b* and 142*a*, and thenceforth out a fluid outlet 157. Thus, during operation a fluid such as engine coolant may flow through passage 151, while air flows through core sections 142*a* and 142*b* to cool the fluid, which may then be subsequently recirculated to further cool an engine or the like.

Another feature of cooling system 124 which may differ from cooling system 24 described above relates to the use of fan 148 to supply compressed air for cleaning filter 130. Each core section 142*a* and 142*b* may include a plurality of micro-channels similar to those described with regard to cooling system 24 above, through which air passes during operation. Rotation of fan 148 may result in compression of air in outlet passage 147 which is subsequently passed through micro-channels 131 and out through filter 130. Thus, one means for cleaning filter 130 may be through operation of fan 148 to supply compressed air which is directed through filter 130. Cooling system 124 may also include a filter cleaner 132 similar to that shown and described with regard to cooling system 24. To this end, filter cleaner 132 may be an air knife 132 positioned adjacent take-up roller 134 and configured to direct compressed air through filter 130 prior to its being wrapped about take-up roller 134. A collector housing 133 may also be provided which collects debris removed from filter 130 rather than allowing it to be returned to the air intake stream and again clog filter 130. Motors 146 may also be associated with each of take-up rollers 134, only one motor being shown, to rotate roller 134 similar to the manner described above with regard to cooling system 24.

Figure 4:
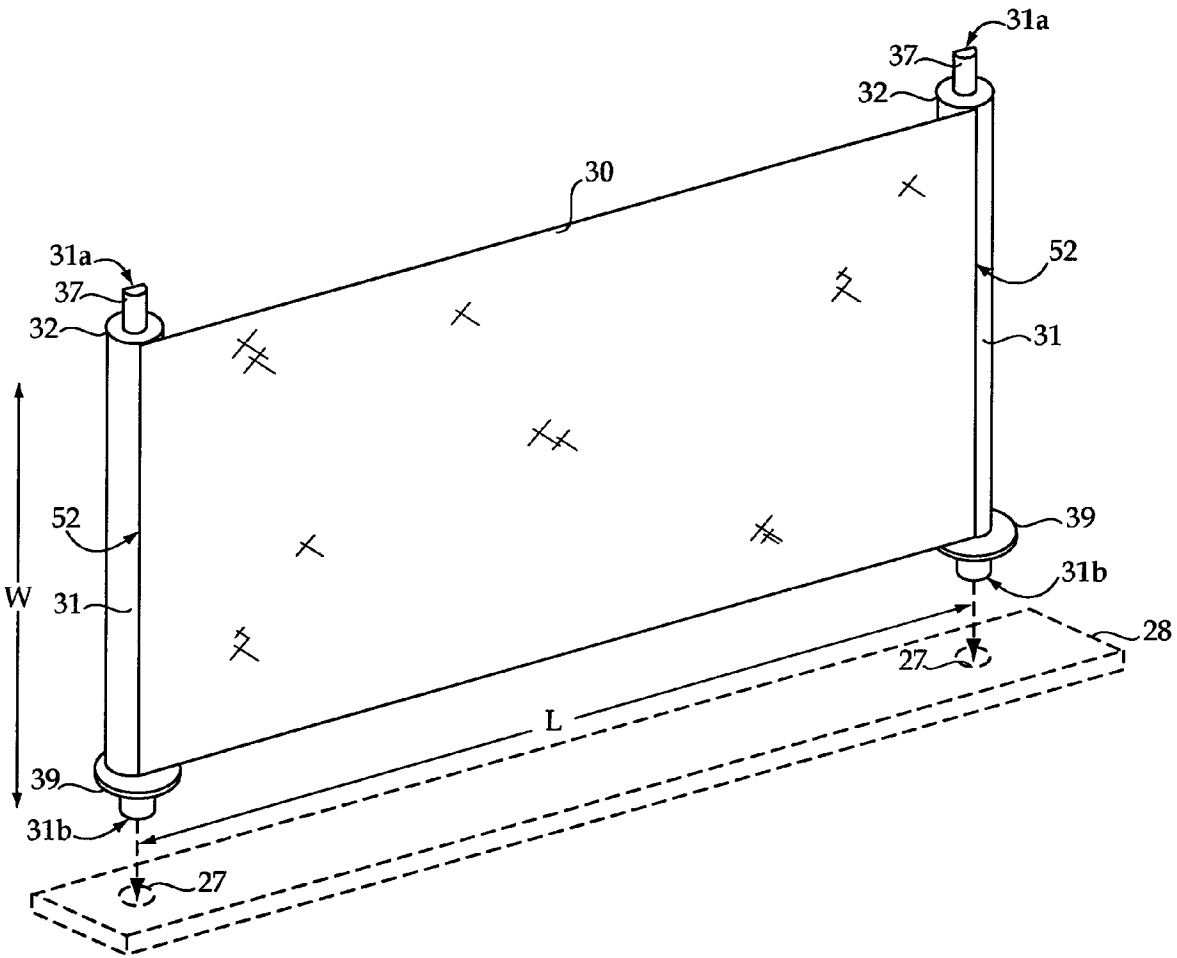
FIG. 4 is a diagrammatic view of a portion of a cooling system according to one embodiment.

Turning now to FIG. 4, there is shown a filter 30 removed from a machine cooling system according to the present disclosure. One aspect of the present disclosure includes a filter as a replacement unit to be substituted for a worn, clogged, damaged, etc. filter. Numerals alike to those used in reference to the FIG. 1 embodiment, described above, are used to denote similar features in FIG. 4. It should be appreciated, however, that the embodiment shown in FIG. 4 is contemplated to be suitable for use in a variety of machine cooling systems. It will be noted that filter 30, comprising a flexible sheet of filter media, has its first end 50 attached to a first roller 32, and has its second end 52 attached to another roller, also identified via numeral 32. Sheet 30 includes a width W, and has a length L which is at least twice, and may be at least three times, width W. Each of rollers 32 includes a first end 31*a* and an opposite, second end 31*b*. A length of each roller 32 extends between its respective ends.

It is contemplated that a wide variety of mounting strategies might be used in positioning filter 30 and its associated rollers 32 in a machine cooling system. One means includes positioning rollers 32 in mounting holes 27 in a portion of the cooling system housing 28. To this end, the second ends 31*b* of each roller 32 may be adapted to position rollers 32, and accordingly sheet 30, at a predefined location relative to housing 28. Each of rollers 32 may further include mounting elements 39 located proximate ends 31*b*, between ends 31*b* and sheet 30. Positioning mounting elements 39 as shown and described will enable filter 30 to be positioned at a desired vertical location relative to the portion of housing 28 serving as a support element therefor, when rollers 32 are engaged in holes 27.

Each of the first ends 31*a* of rollers 32 may further include another mounting element 37. Mounting elements 37 may be configured to position and/or locate rollers 32 at predefined orientations relative to a portion of the corresponding machine or cooling system. In one embodiment, each of mounting elements 37 may comprise a non-circular extension, for example having a D-shaped cross section as shown, which will enable the respective mounting elements 37 to serve as drive elements for rollers 32 by engaging with a corresponding part of a drive motor at a predefined orientation. In other embodiments, rather than mounting elements 37 serving as drive elements, filter 30 itself might be equipped with grommets or the like serving as drive elements. It should be appreciated that the present disclosure is not limited to the use of filters such as are shown in FIG. 4, however, as a replacement part it is contemplated to provide one practical implementation strategy, mounting elements 37 may provide a means for positioning each of rollers 32 in a predefined orientation relative to a drive unit, and mounting elements 39 may similarly provide a means to position rollers 32 at predefined vertical locations relative to housing 28.

INDUSTRIAL APPLICABILITY

Referring to the drawings generally, cooling system 24, 124 may be operated to cool engine 22. Engine coolant will thus be circulated through core 42, 142*a*, 142*b*, having been heated by contact with components of engine 22 in a conventional manner. Cooling air may be drawn through inlet 44, 144 via rotation of fan 28, 128 and ejected out of cooling air outlet 54, 154. While passing through core 42, 142*a*, 142*b*, the cooling air may exchange heat with engine coolant. Filter 30 extends across cooling air inlet 44, 144 and thereby intercepts debris such as organic material, dust, etc. rather than allowing it to pass into core 42, 142*a*, 142*b* and clog the same.

After a period of operation, filter 30, 130 may itself become partially clogged with debris, resulting in a relatively greater pressure drop than is desired, and consequently relatively lower air flow to core 42, 142*a*, 142*b*. As is well known in the art, inadequate flow of cooling air to a heat exchanger will degrade its performance. Accordingly, filter 30, 130 will periodically be repositioned to place a different portion thereof across cooling air inlet 44, 144, reestablishing a desired air flow rate. In one embodiment, shown in particular in FIG. 3, a first pressure sensor 160 positioned upstream of filter 130 may output signals indicative of air pressure to an electronic controller 170. A second pressure sensor 162 positioned downstream filter 130 may also output signals indicative of air pressure to controller 170. By subtracting the respective pressures across filter 130, a pressure drop may be determined. By determining pressure drop, controller 170 may determine when air flow to core 142*a*, 142*b* is less than a desired air flow, and it is thus time to position clean filter material across inlet 144. A similar strategy might be used with cooling system 24. In other instances, rather than sensing pressure drop, positioning of clean filter material across inlet 44, 144 might take place at predetermined intervals, e.g. after a certain number of hours of operation. Further still, some other means such as visual inspection might be used.

In any event, when repositioning of filter 30, 130 such that clean filter material extends across inlet 44, 144 is appropriate, filter 30, 130 may be moved via motors 34, 134 in a desired direction, rolling filter 30 about the corresponding take-up roller 34, 134. Prior to or upon initiating rolling filter 30 about take-up roller 34, 134, filter cleaner 32, 132 may be activated to direct compressed air therethrough, removing debris. When filter 30, 130 has rolled as far as possible onto one take-up roller 34, 134, i.e. when filter 30, 130 has completely unrolled from the opposite take-up roller 34, 134, scrolling may be reversed the next time repositioning of filter material across inlet 44, 144 is needed, and the cleaning and rolling of filter 30, 130 may take place in a reverse direction. As described herein, filter 30, 130 may scroll back and forth across inlet 44, 144, positioning clean filter material in the flow of cooling air for core 42, 142*a*, 142*b* when needed.

The present description is for illustrative purposes only, and should not be construed to narrow the breadth of the present disclosure in any way. Thus, those skilled in the art will appreciate that various modifications might be made to the presently disclosed embodiments without departing from the spirit and scope of the present disclosure. For example, while the foregoing description discusses scrolling filter 30, 130 back and forth across the respective cooling air inlets 44 and 144, the present disclosure is not limited in this regard. Alternative strategies might be used wherein rather than scrolling back and forth, filter 30, 130 is moved in only one direction across the respective cooling air inlet 44, 144. Thus, a continuous loop of filter might extend around the respective heat exchanger. In such an embodiment, rather than take-up rollers, filter 30, 130 might be guided via some other engagement with at least one drive roller, such as a toothed rotating wheel engaging with grommets in filter 30, 130. Other aspects, features and advantages will be apparent upon an examination of the attached drawings and the appended claims.

What is claimed is:

1. A heat exchanger comprising:

a core;

a filtration system comprising a flexible filter configured to filter cooling air for the core, and a first and a second take-up roller attached to the filter, such that scrolling the filter in a first direction wraps the filter about the first take-up roller of and unwraps the filter from the second take-up roller, and scrolling the filter in a second direction wraps the filter about the second take-up roller and unwraps the filter from the second take-up roller;

a first and a second compressed air filter cleaner each having at least one compressed air outlet, and being positioned adjacent to the first and second take-up rollers, respectively, such that upon activating the corresponding filter cleaner compressed air discharged from the at least one compressed air outlet is directed through the filter prior to the filter being wrapped about the corresponding take-up roller;

a housing defining a cooling air inlet, and a first and a second cooling air outlet, and the filter extending across the cooling air inlet and each of the first and second cooling air outlets; and a fan positioned within the housing downstream from the core, such that rotation of the fan draws cooling air through the filter, the cooling air inlet, and the core, and pushes the cooling air out of the first and second cooling air outlets and the filter.

2. The heat exchanger of claim 1 wherein the filter includes a first end and a second end attached to the first and second take-up rollers, respectively, and further comprising a first and a second guide roller contacting the filter between the first and second ends.

3. The heat exchanger of claim 1 wherein each of the filter cleaners comprises an air knife.

4. The heat exchanger of claim 1 wherein the housing includes a plurality of sides, including a front side, a left side, a right side, and a back side, and wherein the cooling air inlet is disposed on the front side, and the first and second cooling air outlets are disposed on the left and right sides, respectively, and wherein the filter extends from the first take-up roller to the second take-up roller about the front, left and right sides of the housing and such that a total of one layer of the filter extends across the cooling air inlet and each of the cooling air outlets.

5. The heat exchanger of claim 4 further comprising a first guide roller and a second guide roller positioned at opposite sides of the cooling air inlet and configured to guide the filter between said take-up rollers during scrolling across the cooling air inlet.

6. A heat exchanger comprising:

a core; and a filtration system comprising a flexible filter configured to filter cooling air for the core, at least one rotatable drive element coupled with the filter, and a filter cleaner having at least one compressed air outlet configured to direct compressed air through said filter;

a housing including a plurality of sides, a cooling air inlet disposed on one of the plurality of sides, and at least one cooling air outlet disposed on another of the plurality of sides, and wherein said filter extends across the cooling air inlet and the at least one cooling air outlet;

wherein the filter cleaner comprises at least one air knife;

wherein the core includes a first core section and a second core section, said heat exchanger further comprising a fan fluidly positioned between the first and second core sections; and wherein the fan comprises a tangential fan configured to draw air through the first core section via an inlet passage connecting with the cooling air inlet and configured to blow air through the second core section via an outlet passage connecting with the at least one cooling air outlet, and wherein the filter cleaner further comprises at least one compressed air outlet fluidly connected with the outlet passage.

7. The heat exchanger of claim 6 wherein the filter cleaner further comprises a collector for debris removed from said filter via said at least one air knife.

* * * * *